United States Patent [19]

Schwarzwälder

[11] Patent Number: 4,881,561

[45] Date of Patent: Nov. 21, 1989

[54] PROCESS AND DEVICE FOR THE FULLY AUTOMATIC CLEANING OF SPRAY GUNS FOULED WITH PAINT OR VARNISH

[76] Inventor: Gottlob Schwarzwälder, Max-Eyth-Strasse 15, 7488 Wolfschlugen, Fed. Rep. of Germany

[21] Appl. No.: 241,187

[22] Filed: Sep. 7, 1988

[30] Foreign Application Priority Data

Sep. 14, 1987 [DE] Fed. Rep. of Germany ..... 3730828
Oct. 9, 1987 [DE] Fed. Rep. of Germany ..... 3734267

[51] Int. Cl.[4] ..... B08B 3/10

[52] U.S. Cl. ..... 134/76; 134/95; 134/111; 134/142; 134/166 R; 134/170; 134/184; 134/200

[58] Field of Search ..... 134/56 R, 61, 76, 104, 134/135, 140, 142, 146, 166 R, 168 R, 170, 198, 200, 184, 111

[56] References Cited

U.S. PATENT DOCUMENTS

| | | | |
|---|---|---|---|
| 847,129 | 3/1907 | Sunkle | 134/76 |
| 3,910,297 | 10/1975 | Pinkham | 134/76 |
| 4,333,485 | 6/1982 | Karlsson et al. | 134/60 |
| 4,409,999 | 10/1983 | Pedziwiatar | 134/184 X |
| 4,493,333 | 1/1985 | Layton | 134/76 |
| 4,520,834 | 6/1985 | DiCicco | 134/76 |
| 4,788,786 | 12/1988 | Suter | 134/61 |

*Primary Examiner*—Frankie L. Stinson
*Attorney, Agent, or Firm*—Nies, Webner, Kurz & Bergert

[57] ABSTRACT

The invention refers to a process and a device for the fully automatic cleaning of spray guns foulded with paint or varnish, wherein the spray guns are immersed with their paint or varnish reservoir open into a cleaning fluid free of solvents or thinners, during a first cleaning phase the fluid is circulated and a fluid jet is introduced into the open paint or varnish reservoir or into the paint or varnish inlet, during a second phase ultrasonic waves are introduced into the cleaning fluid while the spray guns are moved oscillating up and down in the fluid, the two cleaning phases are repeated at least once and the spray guns are subsequently repeatedly immersed in a rinsing fluid and, if applicable, are moved therein, while the rinsing fluid is circulated and a rinsing fluid stream is introduced into the open paint or varnish reservoir or into the paint or varnish inlet.

11 Claims, 4 Drawing Sheets

PROCESS AND DEVICE FOR THE FULLY AUTOMATIC CLEANING OF SPRAY GUNS FOULED WITH PAINT OR VARNISH

BACKGROUND OF THE INVENTION

This invention refers to a process and a device for the fully automatic cleaning of spray guns which have been fouled with paint or varnish.

The cleaning of spray guns for paint and varnish is not only time-consuming, but it is also extremely hazardous to health due to the use of solvents. Persons continuously or frequently in contact with solvents often suffer from more or less serious skin diseases and other illnesses which frequently lead to job disability.

Known cleaning fluids, however, not only pose health risks, they are also environmentally harmful, so that waste disposal is frequently problematical and requires a substantial expenditure. The environment is heavily burdened by improper disposal.

A device for the cleaning of spray guns has become known in the No. EP-A2 0 230 245, this device having a vat into which an outlet for a jet of cleaning fluid opens, under which the spray gun to be cleaned must be held by hand to rinse off the paint and varnish residue adhering to it. The fluid containing the paint residue is collected in the vat, drawn out of the same, purified and returned to the circuit. The cleaning fluid consists of solvents, for which reason a suction device is also provided at the vat for removal of the necessarily arising vapors. Cleansing of the conduits and hollow spaces in the interior of the spray gun is carried out merely by filling the paint reservoir with a solvent which is then driven by compressed air through the conduits of the spray gun to flush them out, with the spray nozzle of the spray gun being held to the mouthpiece of a suction device. It is clear to each and every person skilled in the art that the known device is absolutely unsuitable for practical application and, furthermore, is hazardous to health and provides virtually no improvement over cleaning methods common up to now.

SUMMARY OF THE INVENTION

The invention is based on the task of suggesting a process according to which a quick and complete, and as fully automatic a cleaning as possible of spray guns fouled with paint or varnish can be achieved without the use of the usual specific solvents for paints and varnishes, without having to fear harm to health and without undue damage to the environment. Furthermore, a device particularly suited to carrying out the process and meeting all demands made of it was to be created.

The above-given task is solved according to the invention, on the one hand, by a process with the features given in claim 1, and on the other hand, by a device with the features of claim 5.

Additional features both of the process suggested in accordance with the invention and of the device in question arise from the subclaims as well as from the following description of preferred embodiments shown in FIGS. 1 to 6 of the drawings.

DETAILED DESCRIPTION OF THE DRAWINGS

Figure 1:
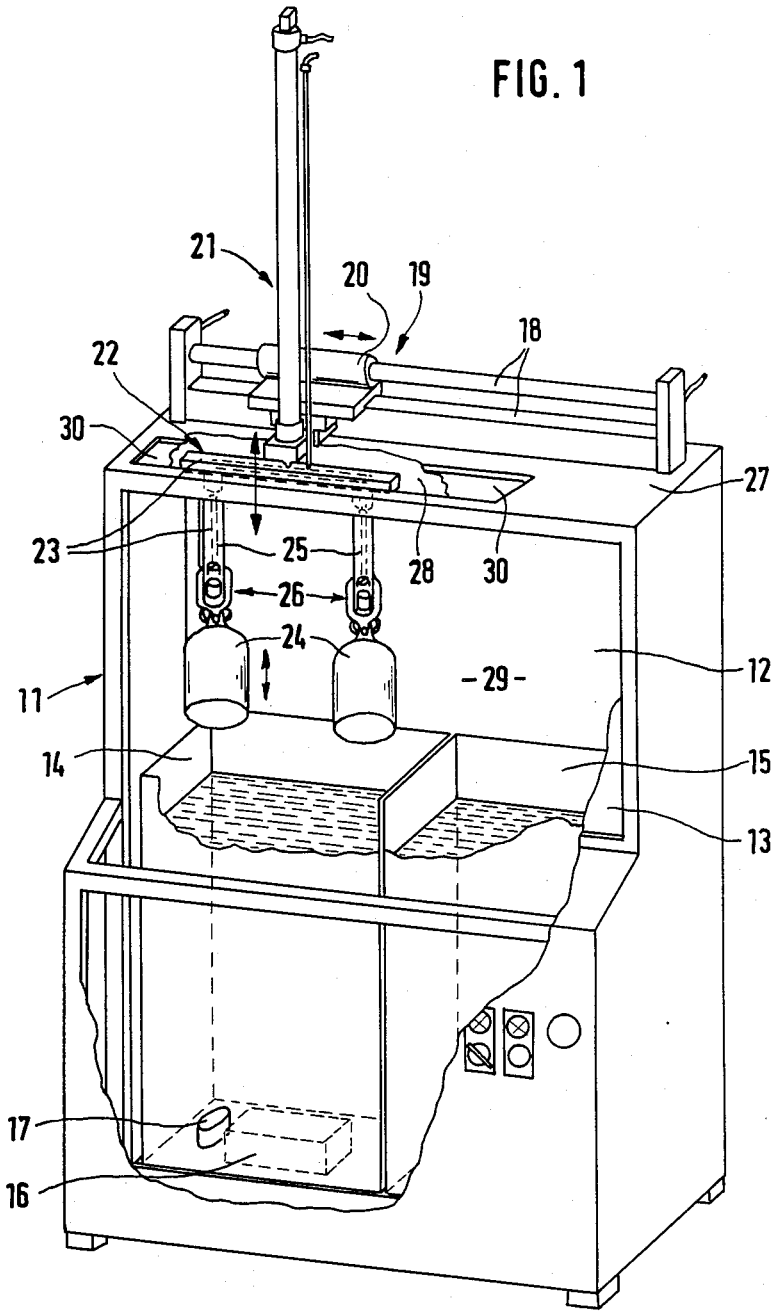
FIG. 1 shows a perspective, schematic view of the cleaning device designed in accordance with the invention.

As seen in FIG. 1, the device, in a first embodiment, consists of a cabinet-like housing 11 with a loading and removal opening 12 in its front side, this opening being closable by means of sliding doors 13. Closely juxtaposed in the lower part of the cabinet-like housing are two containers 14 and 15 open at the top, both of which contain a cleaning fluid, or one containing a cleaning fluid and the other containing a rinsing fluid.

The spray guns 24 to be freed from paint and varnish residue are first immersed into the fluid of container 14 and subsequently into that of container 15. Sonic heads 16*a* excited by an ultrasonic device 16 located in the housing 11 of the cleaning device are provided on the walls and, if applicable, on the floor of the container 14, the oscillations of these sonic heads being transferred to the fluid located in the container 14. If applicable, sonic heads can likewise be provided for the second container 15.

The cleansing effect can be improved if a circulating means, for instance in the form of a circulating pump 17, is associated with the containers 14, 15 holding the cleaning and/or rinsing fluid, by means of which the fluid can be moved continuously or, if applicable, intermittently.

Above the containers 14, 15 a transverse guideway 19 consisting of guide rails 18 is located, along which guideway a transport carriage 20 supporting an elevating mechanism 21 can be reciprocated. A holder 22 for the spray gun to be cleaned can be vertically moved up and down by the elevating mechanism 21. A holder 22 is shown in the drawing, to which holder two spray guns 24 can be attached to be immersed into and lifted out of the fluid in the containers 14 and 15. The holder 22 consists of a bar structure 23 fixed to the elevating mechanism 21. Connecting pieces or couplings 26 are provided at the lower end of the bar structure 23, to which the compressed air connections of the spray guns 24 to be cleaned can be fastened. The couplings 26 are connected to compressed air lines 25, if applicable, to enable air to be blown through the conduits into the spray guns if so desired. However, it is also possible to connect the couplings to compressed fluid lines to enable cleaning or rinsing fluid to be forced through the conduits of the spray guns 24.

The guideway 19 and the entire means for moving the spray guns 24 to be cleaned during the cleaning process can, as shown in the drawing, be disposed outside of the housing 11, and particularly above its upper cover plate 27. In this case the elevating mechanism 21 projects through a slot 28 in the cover plate 27 into the housing interior 29. In order to close the housing 11 in the area of the slot 28 in the cover plate 27 as well, movable slide bars or bands 30 displaced with each movement of the elevating mechanism 21 along the slot 28 are provided.

However, it is also possible to locate the guideway 19 inside the housing 11. To avoid having the constructional height of the housing 11 thereby become too great, the elevating mechanism can, for instance, have a telescopic bar structure or the like, with the holder or basket for the spray guns to be cleaned disposed at the lower end thereof.

During the cleaning process the carriage 20 is moved transversely and the holder 22 is moved vertically. This takes place by means of motor drive elements, for instance in the form of a pneumatic, hydraulic or electric drive motor or servomotor or the like, if applicable with intermediate action of a gearing or a drive unit, using suitable, known components. The drive elements are controled by a control device according to a certain adjustable program, in order that the movements of the moved parts to be made during the cleaning process are executed automatically in sequence. In a simplified embodiment of the device a semi-automatic or even a purely manual control can be provided.

The cleaning of the spray guns fouled with color or varnish takes place as described below:

The spray guns to be cleaned are attached to the bar structure 23 of the holder 22 and are connected, if applicable simultaneously, to the lines for compressed air or compressed fluid.

When the spray guns 24 to be cleaned are fixed to the holder 22 and the sliding doors 13 of the cabinet-like housing 11 are closed, as soon as the spray guns 24 are immersed into the cleaning fluid, the ultrasonic device 16 is actuated, whereof the sonic heads **16*a* transfer the oscillatory energy to the fluid in contact with them in the container 14. Then the spray guns 24 are moved preferably repeatedly up and down in the cleaning fluid in the container 14 by means of the elevating mechanism 21. During the immersion of the spray guns 24 into the cleaning fluid compressed air and/or compressed fluid, for example, can be forced via the lines 25 and the connecting couplings 26 through the conduits and hollow spaces in the interior of the spray guns 24**.

During the cleaning process, the cleaning fluid is continuously moved by the circulating pump 17, particularly to distribute in the cleaning fluid the paint residue removed from the spray guns to be cleaned. A second and possibly a third cleaning process, as well as at least one rinsing process preferably follow the cleaning process described above. The cleaning and the rinsing fluids are continuously circulated by the circulating pump during the cleaning and the rinsing process, wherein they pass through a filter.

For the rinsing the spray guns 24 to be cleaned are lifted out of the cleaning fluids in the container 14 and are subsequently immersed in the fluid in the second container 15 and moved in the same. After the rinsing process the cleaned and rinsed spray guns are lifted out of the fluid in the container 15. To remove fluid still adhering to them, an oscillator causing the bar structure 23 and hence the spray guns 24 to vibrate can be provided at the holder 22.

For the definitive elimination of the residual moisture still adhering to them, the spray guns can be put into a drying chamber to expose them for drying to a stream of warm air, for example.

All working operations conducted during the method steps described above can be controlled, preferably fully automatically, by a control device located in the housing 11. However, when necessary, individual working operations can be conducted with manual control.

Figure 2:
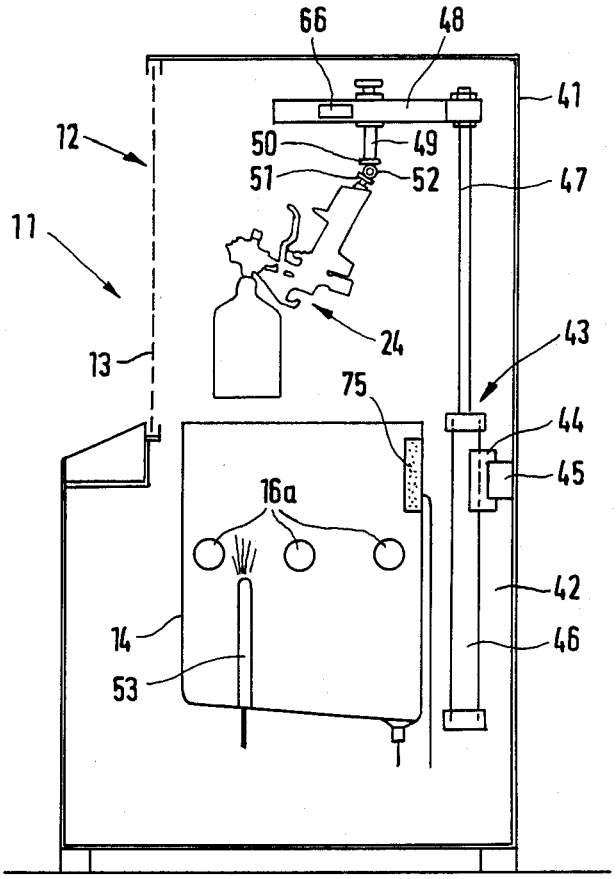
FIG. 2 shows a cross section through a second embodiment of a device designed in accordance with the invention.

The device according to FIG. 2 has the same structure in principle as that according to FIG. 1, differing from it essentially in that a hollow space 42 is located between the containers 14 and 15 for the cleaning and/or rinsing fluid and the rear wall 41 of the housing 11, in which hollow space the elevating mechanism 43 with its carriage 44 can be moved back and forth along the guide rail 45 mounted on the rear wall 41.

Figure 3:
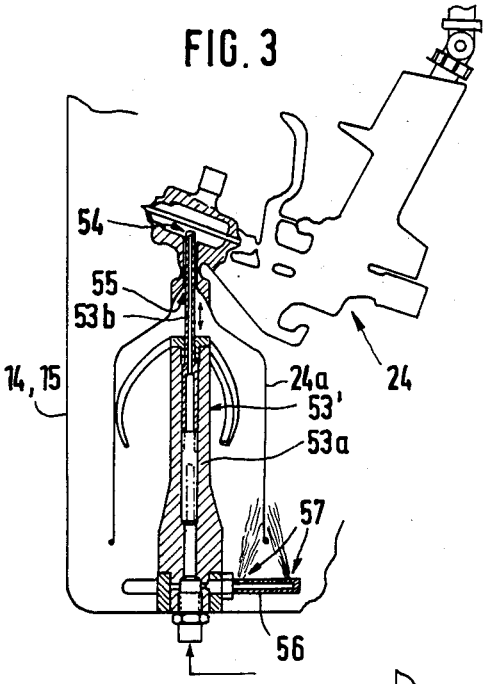
FIG. 3 and FIG. 4 respectively show one of two embodiments of a jet pipe with jet nozzle disposed in the fluid containers and passing into the paint reservoir of the spray gun.

The elevating mechanism 43 shown consists of a common pneumatic or hydraulic cylinder 46, of which the upwardly extendable piston rod 47 is provided with a supporting arm 48 carrying the holder 49 with the bar structure 50 for the connecting couplings 51. The holder 49 is advantageously adjustable along the supporting arm 48 and can be clamped thereto and has joints 52 between the bar structure 50 and the couplings 51, which joints permit the adjustment of the spray guns 24 to a position in which the axis of the paint reservoirs **24*a* of the spray guns 24 is vertical and coaxial to that of the jet pipes 53 or 53' with the jet nozzles 54, which are fixed in an opening in the bottom 14*a* and/or 15*a* of the containers 14 and 15, as shown in particular in FIG. 3. The jet pipe 53 with its jet nozzle 54 at the upper free end has the task of introducing a jet of cleaning and/or rinsing fluid into the paint feed conduit 55 and in the hollow spaces in the interior of the spray guns 24, in order to free them, too, of paint or varnish residue. The jet pipe 53 or 53' can, as shown in FIG. 3, be designed as a telescopic pipe, wherein the pipe portion 53*b* carrying the nozzle 54 and mounted in the pipe portion 53*a* so as to be axially displaceable is upwardly extended when pressure is applied and the jet nozzle 54 enters the paint feed conduit 55. Several radial pipe segments 56 are located at the lower end of the jet pipe 53 or 53' with the jet nozzles 57 of said pipe segments being adjusted so that the jets exiting from them flow tangentially toward the outer and advantageously also the inner wall of the paint reservoir 24*a* and thereby likewise provide for movement of the fluid in the containers 14 and 15**.

Figure 4:
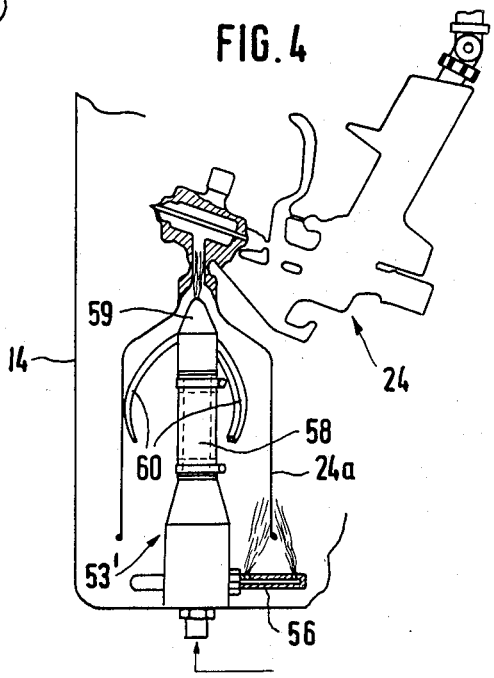

However, it is also possible for the jet pipe 53 to be self-centering. To this end the jet pipe 53', as shown in FIG. 4, is provided with a flexible hose piece 58 having at its upper free end a jet nozzle 59 with flexible radial feelers 60 which glide along the inner wall of the paint reservoir **24*a* when it is slipped over them and thereby center the jet nozzle 60**.

Figure 5:
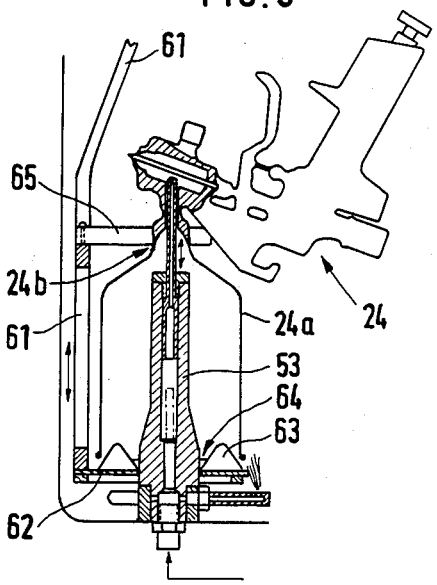
FIG. 5 shows a second embodiment of a spray gun holder.

In another embodiment of the holders for the spray guns 24, as shown in FIG. 5, bar structures 61 are connected to the elevating mechanism, said bar structures carrying at their lower end a platform 62 consisting of a perforated plate or a grid or the like, onto which platform the paint reservoirs **24*a* of the spray guns 24 are set. Centering cones or metal sheets 63 are disposed on the platform 62 for centering the spray guns and are arranged around the orifice 64 for the jet pipe 53. For the secure and unalterable support of the spray guns 24 a clamping device 65 is seated on the bar structure 61, said clamping device comprising, for example, a clamp engaging the neck 24*b* of the paint reservoir 24*a***.

Figure 6:
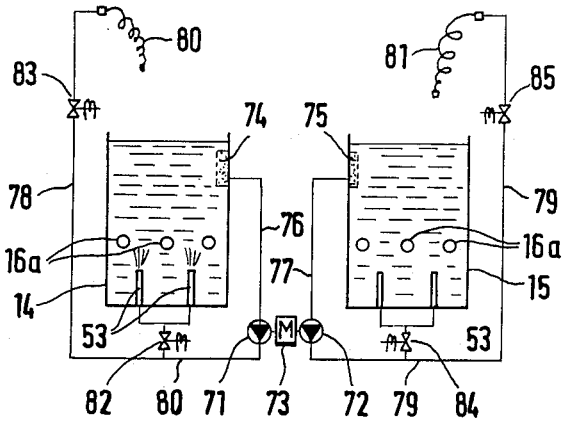
FIG. 6 shows a schematic view of the fluid system of the devices.

The cleaning and/or rinsing system of the apparatus is shown as an example in FIG. 6. It is advantageous to separate the circuits for the cleaning fluid in the container 14 and for the rinsing fluid in container 15 from one another to avoid a mixture of the two fluids with one another, even when the respective cleaning and rinsing processes take place successively and it would therefore be possible to manage with only one circulating pump. However, for economic reasons, both circulating pumps 71 and 72 could be driven by only one single motor 73.

The fluid in the containers 14 and 15 first flows through the filters 74 and 75 disposed on a wall and having exchangeable filter bodies, and reaches the pump 71 or 72 via the intake line 76 or 77. The pressure line 78 or 79 can be connected either to the jet pipes 53 in the interior of the containers 14 and 15 or to the flexible connecting hose 80 or 81. The control takes place with the aid of the electromagnetic valves 82, 83 or 84, 85. The flexible connecting hoses 80, 81 are provided in the event that spray guns without paint reservoirs, but with a connection piece for coupling on a paint feed line are to be cleaned. For cleaning the conduits and hollow spaces in the interior of such spray guns the cleaning and/or rinsing fluid is supplied to them via the hoses 80 and 81 coupled to the paint feed connection pieces.

In the following table the work sequence for the cleaning of spray guns suggested in accordance with the invention making use of the devices described above is represented on the basis of an example.

Sequence of Operations in the Cleaning and Rinsing of Spray Guns

| Phase | Immersion | Lifting out | Circulation | Ultrasonic Treatment | Movement | Rest Period |
|---|---|---|---|---|---|---|
| | | Cleaning: Phases I to IV | | | | |
| I/ 1. | ↓ | | | | | |
| 2. | | | 15 sec | | | |
| 3. | | | 2 × 40 sec | 120 sec | | |
| 4. | | ↑ | | | | |
| 5. | | | | | | 15 sec |
| II/ 6. | ↓ | | | | | |
| 7. | | | 30 sec | | | |
| 8. | | ↑ | | | | |
| 9. | | | | | | 15 sec |
| III/10. | ↓ | | | | | |
| 11. | | | 30 sec | 30 sec | | |
| 12. | | ↑ | | | | |
| 13. | | | | | | 15 sec |
| IV/14. | ↓ | | | | | |
| 15. | | | 30 sec | | | |
| 16. | | ↑ | | | | |
| 17. | | | | | | 30 sec |
| | | Rinsing: Phases V to VII | | | | |
| V/18. | ↓ | | | | | |
| 19. | | | 30 sec | | | |
| 20. | | ↑ | | | | |
| VI/21. | ↓ | | | | | |
| 22. | | | 30 sec | | | |
| 23. | | ↑ | | | | |
| VII/24. | ↓ | | | | | |
| 25. | | | 30 sec | | | |
| 26. | | ↑ | | | | |
| 27. | | | | | | 30 sec |
| VIII | Vibration | | | | | |
| IX | Removal | | | | | |
| X | Drying | | | | | |

As the entire cleaning takes place in a closed space, virtually no substances get into the environment. As practical experience has shown, the cleaning effect achieved is extraordinarily great, without the necessity of using a cleaning fluid containing a solvent. The cleaning of the soiled objects takes place quickly and gently, without the objects coming into contact with parts of the body of the persons occupied with the cleaning.

Insofar as only one spray gun is mentioned above, this is done to facilitate the description. Of course, two or if applicable even three spray guns can also be handled simultaneously and in the same manner as the one spray gun described.

What is claimed is:

1. A device for the fully automatic cleaning of spray guns fouled with paint or varnish, characterized by the combination of the following features:

(a) two preferably closely juxtaposed containers (14, 15) open at the top and containing a cleaning fluid on the one hand and a rinsing fluid on the other are disposed in a cabinet-like housing (11) with a closable loading and removal opening (12);

(b) at least one sonic head (16) emitting ultrasonic waves is disposed on the one side wall and/or on the bottom at least of the container (14) containing the cleaning fluid;

(c) a vertically reciprocal holder (22; 49) is mounted above the containers (14, 15), with preferably adjustable holding elements (23, 25, 26; 50–52; 61–63, 65) for hanging on or supporting the spray guns (24) being disposed on said holder;

(d) the vertically reciprocal holder (22; 49) is connected to a motor-driven elevating mechanism (21; 43) mounted on a motor-driven carriage (20; 44) displacing said elevating mechanism horizontally back and forth;

(e) associated with the containers (14, 15) is a circulating and filter means moving the fluid contained in said containers;

(f) the conduit (78, 79) feeding the fluid back into the containers (14, 15) is connected to one or more jet pipes (53, 53') provided with jet nozzles (54, 59), said jet pipes projecting into the open paint reservoir (**24*a*) of the spray gun (24) immersed in the cleaning and/or rinsing fluid, and to one or more flexible connecting hoses connectable to the paint inlet and/or, if applicable, also to the compressed air inlet of the spray guns (24**).

2. A device according to claim 1, characterized in that a vertical jet pipe (53, 53') or the like communicating with the hydraulic line and carrying a jet nozzle (54, 60) is fixed to the bottom of the containers (14, 15), with said jet pipe or the like entering the interior of the paint reservoir (**24*a*) upon the downward motion of the spray gun (24**).

3. A device according to claim 2, characterized in that the jet pipe (53, 53') is designed as a telescopic pipe consisting of two parts (**53*a*, 53*b*), whereof the inner pipe (53*b*) carrying the jet nozzle (54) is slidable out of the outer pipe (53*a*) upon application of pressure and enters the paint inlet of the gun (24**).

4. A device according to claim 2 characterized in that several radial, outwardly extending pipe segments (56) are connected to the jet pipe (53, 53') with the jet nozzles (57) thereof being directed at a tangent toward the outer and, if applicable, inner side of the paint reservoir (**24*a*) of the spray gun (24**).

5. A device according to claim 1, characterized by compressed air lines or hoses connected to the spray gun couplings or connectable to the compressed air and/or paint feeding connections or couplings.

6. A device according to claim 1, characterized in that the horizontal guide rail (19) for the carriage (20) carrying the elevating mechanism (21) is mounted below or above the upper cover plate (27) of the housing (11) and the elevating mechanism (21) projects into the housing interior through a slot (28) located in the upper cover plate (27), said slot being covered by means of movable slide bars or bands (30).

7. A device according to claim 6, characterized in that the carriage (20; 45) and the elevating mechanism (21; 43) are movable by means of a pneumatic, hydraulic or electric drive motor, if applicable with use of an intermediate gearing.

8. A device according to claim 6, characterized in that the elevating mechanism (21; 43) is connected to a bar structure (61) carrying a platform (62) as support plate for the spray guns (24), said platform having an orifice (64) for the jet pipe (53) and being provided with centering bodies (63) for the open paint reservoirs (24*a*) of said spray guns, said bar structure having a clamping device (65) holding and fixing the spray gun (24).

9. A device according to claim 1, characterized in that the horizontal guide rail (45) for the carriage (44) carrying the elevating mechanism (43) is mounted between the containers (14, 15) and the rear wall (41) of the housing (11).

10. A device according to claim 1 characterized in that an oscillator (66) is located on the holder (22; 49).

11. A device according to claim 1, characterized in that a drying chamber is located in or on the housing (11).

* * * * *

UNITED STATES PATENT AND TRADEMARK OFFICE

CERTIFICATE OF CORRECTION

PATENT NO. : 4,881,561

DATED : November 21, 1989

INVENTOR(S) : GOTTLOB SCHWARZWALDER

It is certified that error appears in the above-identified patent and that said Letters Patent is hereby corrected as shown below:

ON THE COVER SHEET:

In the ABSTRACT (item 57), line 2 the word "foulded" should be "fouled".

IN THE SPECIFICATION:

Column 5, lines 34 and 41, in both places, under the column of the table designated movement, a vertical double-headed arrow ( ↕ ) should be shown.

Signed and Sealed this

Sixth Day of November, 1990

*Attest:*

HARRY F. MANBECK, JR.

*Attesting Officer*

*Commissioner of Patents and Trademarks*